US009802328B2

(12) United States Patent
Witkus et al.

(10) Patent No.: US 9,802,328 B2
(45) **Date of Patent: *Oct. 31, 2017**

(54) RAZOR CARTRIDGE GUARD STRUCTURE

(71) Applicant: The Gillette Company, Boston, MA (US)

(72) Inventors: Stephen Charles Witkus, Northbridge, MA (US); Neil Lettenberger, Boston, MA (US); Armando Miguel Hurtado, Boston, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/535,718

(22) Filed: Nov. 7, 2014

(65) Prior Publication Data

US 2015/0128424 A1 May 14, 2015

Related U.S. Application Data

(60) Provisional application No. 61/903,907, filed on Nov. 13, 2013.

(51) Int. Cl.
*B26B 21/40* (2006.01)
*B26B 21/22* (2006.01)

(52) U.S. Cl.
CPC ..... *B26B 21/4018* (2013.01); *B26B 21/222* (2013.01)

(58) Field of Classification Search
CPC ..... B26B 21/14; B26B 21/165; B26B 21/16; B26B 21/22; B26B 21/222; B26B 21/225; B26B 21/4012; B26B 21/4018
(Continued)

(56) References Cited

U.S. PATENT DOCUMENTS 2,911,713 A * 11/1959 Kuhnl ..... B26B 21/24 30/62
3,722,090 A * 3/1973 Dawidowicz ..... B26B 21/40 30/34.2

(Continued)

FOREIGN PATENT DOCUMENTS

AT 385938 6/1988

OTHER PUBLICATIONS

PCT International Search Report with Written Opinion in corresponding Int'l appln. PCT/US2014/065382 dated Mar. 5, 2015.

*Primary Examiner* — Jennifer Swinney
(74) *Attorney, Agent, or Firm* — Joanne N. Pappas; Kevin C. Johnson; Steven W. Miller

(57) ABSTRACT

A novel guard structure of a razor is shown including rows of elongated hard plastic protrusions having rounded (e.g., not sharp or pointed) tips arranged on a tip curved profile. The rounded valleys between the protrusions are also arranged on a curved profile which may be different than that of the tip curved profile. The valleys encompass an inner protrusion volume which increases going back to front end of the guard structure. Preferably, the front end volumes are larger than the back end inner protrusion volumes to assist in trapping and distributing shaving aid. In one embodiment having six protrusions, the inner protrusion volume between a second and third protrusion is the largest, while a volume between first and second protrusion is the second largest volume. The guard structure is disposed in front of the blades formed within the housing and may extend past the front end of the housing.

14 Claims, 6 Drawing Sheets

(58) Field of Classification Search
USPC ..... 30/50, 77
See application file for complete search history.

(56) References Cited

U.S. PATENT DOCUMENTS 3,775,845 A * 12/1973 Kuhnl ..... B26B 21/16 30/41
3,815,233 A * 6/1974 Carroll ..... B26B 21/165 16/422
3,816,914 A * 6/1974 Wordtmann ..... B26B 21/16 30/346.58
5,067,238 A * 11/1991 Miller ..... B26B 21/4018 30/34.2
5,113,585 A 5/1992 Rogers et al.
5,249,361 A * 10/1993 Apprille, Jr. ..... B26B 21/4018 30/34.2
5,313,706 A 5/1994 Motta et al.
5,416,973 A * 5/1995 Brown ..... B26B 21/4025 30/34.2
5,546,660 A 8/1996 Burout et al.
5,689,883 A 11/1997 Ortiz et al.
5,794,343 A 8/1998 Lee et al.
6,182,365 B1 2/2001 Tseng et al.
6,412,176 B1 7/2002 Prochaska et al.
6,651,342 B1 * 11/2003 Walker, Jr. ..... B26B 21/4018 30/34.2
6,675,479 B1 * 1/2004 Walker, Jr. ..... B26B 21/4018 30/34.2
7,043,840 B2 5/2006 Walker, Jr. et al.
8,186,062 B2 5/2012 Fischer et al.
2001/0023539 A1 * 9/2001 Kwiecien ..... B26B 21/222 30/50
2005/0198840 A1 9/2005 Worrick, III et al.
2010/0175265 A1 * 7/2010 Bozikis ..... B26B 21/227 30/50
2010/0313424 A1 * 12/2010 Johnson ..... B26B 21/222 30/34.2
2011/0016724 A1 * 1/2011 Murgida ..... B26B 21/22 30/50
2011/0203113 A1 * 8/2011 Wang ..... B26B 21/4025 30/41
2013/0097872 A1 * 4/2013 Blatter ..... B26B 21/4018 30/50

* cited by examiner

RAZOR CARTRIDGE GUARD STRUCTURE

FIELD OF THE INVENTION

This invention relates to razor blades, and more particularly to an improved guard structure.

BACKGROUND OF THE INVENTION

A wet shave razor cartridge is usually composed of a cartridge housing, blades having cutting edges, a guard area in front of the blades having a guard structure and a cap area having a shaving aid or lubricating strip disposed behind the blades. Each component plays a unique role during shaving.

Turning to the guard area specifically, as it is known in the art, a guard structure of a razor cartridge typically includes resilient or soft material, often arranged in the form of flexible fins or protrusions, disposed in front of the blades to engage the skin's surface by stimulating and stretching the skin in front of the blades, tending to improve comfort while also properly positioning the skin for cutting of hairs. It is generally known in the art that fin guards, placed in the front of the razor blades, play an important role for the engagement, alignment, and extension of hair while also managing the skin during shaving.

Most guard components on the market today are made of a thermoplastic or elastomeric material (e.g., flexible fins) with tips having acute points (e.g., sharp, pointy tips). The tips of the fins are generally disposed such that they are all at the same height or a portion of the fins are all at the same height for constant skin contact. In general, an elastomeric guard is generally costly and time-consuming to manufacture as most methods to assemble a guard generally require a two-color injection molding process in order to effectively bond the flexible material of the guard onto a generally hard plastic base material (e.g., polystyrene) of the overall housing on which the guard is typically supported.

It would be desirable to reduce the cost and time to manufacture the guard structure of the razor cartridge while still providing adequate shaving performance attributes such as skin management, comfort, efficiency and safety.

SUMMARY OF THE INVENTION

In one aspect, the present invention includes rows of elongated hard plastic protrusions having rounded (e.g., not sharp or pointed) tips arranged on a tip curved profile. The rounded valleys between the protrusions are also arranged on a valley curved profile which may be different than that of the tip curved profile. The valleys encompass an inner protrusion volume which increases going back to front end of the guard structure. In a preferred embodiment, the front end volumes are larger than the back end inner protrusion volumes to assist in trapping and distributing shaving aid.

In one embodiment having at least four protrusions, the inner protrusion volume between a second and third protrusion is the largest, while a volume between first and second protrusion is the second largest volume.

In another aspect, the guard structure is disposed in front of the blades which are formed within the housing and may desirably extend past the front end of the housing.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
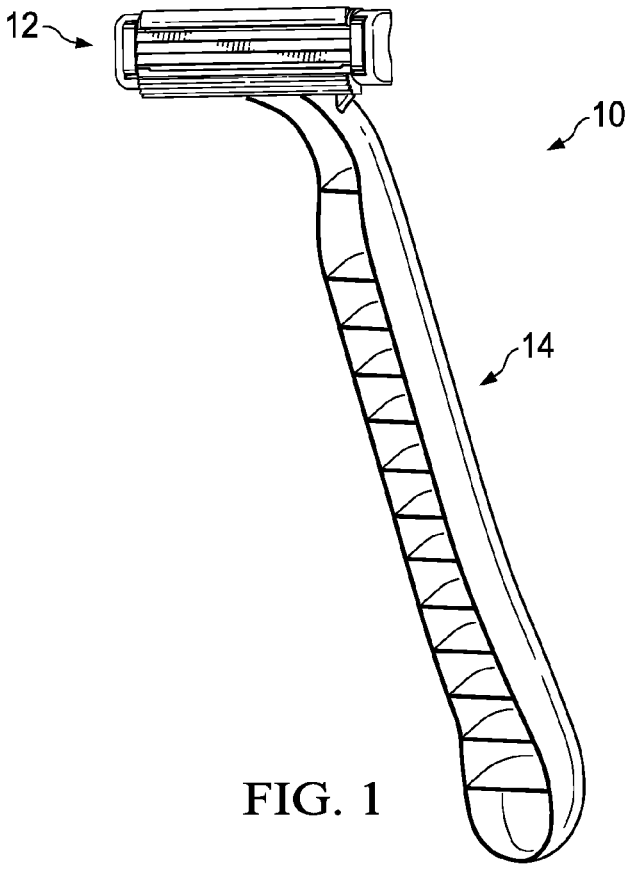
FIG. 1 is a perspective view of a razor having a cartridge and a handle in accordance with the present invention.

Choosing materials, properties and configurations for an appropriate lower cost guard structure (e.g., generally defined as the area in front the blades), leveraging the synergistic effect between the guard structure, the skin and the blades, may be desirable for providing beneficial shaving performance attributes, such as consistent shave closeness and comfort during wet shaving.

In the present invention, the term "guard structure" signifies a physical structure which may engage, hold, or stretch a user's skin for skin management during shaving and may be comprised of, though not limited to, one or more fin elements, elongated filaments or protrusions, or nubs. The guard structure generally be upstanding or curved, rigid or flexible, may have planar or non-planar surfaces, may be contiguous, non-contiguous, patterned, or any combination thereof. It may be made by injection molding techniques for low cost and manufacturing simplicity of using a single material (e.g., as the housing).

The guard structure of the present invention is preferably comprised of hard plastic material comprised of polystyrene, polyphenylene oxide, polypropelene, acrylonitrile butadiene styrene, or high impact polystyrene or materials that are not flexible.

However, it is contemplated in the present invention that the guard structure alternatively may have portions or be wholly comprised of any type of material such as, but not limited to, polystyrene, elastomers, rubbers or other polymers. Elastomers such as silicone, fluorosilicone, polyisoprene, polybutadiene, polyisobutylene, copolymers such as styrene-ethylene-butylene-styrene (SEBS) based thermoplastic elastomer, styrene-ethylene-propylene-styrene (SEPS) based thermoplastic elastomer, polyoxyethylene-polyurethane based elastomer, or rubbers such as acrylonitrile-butadiene, polyacrylate and natural rubber, or other polymers such as polyurethane, polystyrene and polyethylene, or any combination thereof are also contemplated in the present invention. Additionally, the guard structure material may include modifications of one or more of the above-listed materials (e.g., polymers and rubbers and their composites) with other materials. Finally, the materials may include textile or fabric materials, natural materials (e.g., wood), or metals coated with elastomeric or plastic materials.

As will be described below, the guard structure of the present invention, generally defined as the upper, or as the case may be the uppermost skin contacting surface of the guard area in front of the blades, desirably utilizes an effective arrangement of hard plastic protrusion elements (e.g., in a preferred embodiment, perpendicular to the shave direction) whose elongated protrusions have curved or rounded tips or peaks (as opposed to an acute or sharp) tip, rounded valleys, and whose protrusions' tips and valleys of tips are disposed on a curve or circular path, and which together provides desirable contact with a user's skin to better affect skin management and the ability to better distribute shaving aid material (e.g., shave preparation, skin gels) evenly over the skin.

The guard structure of the present invention generally extends beyond the housing structure. By not being within the boundaries of the housing the guard structure of the present invention generally provides a beneficial skin contact point for a user's skin before engagement with the blades.

Figure 2:
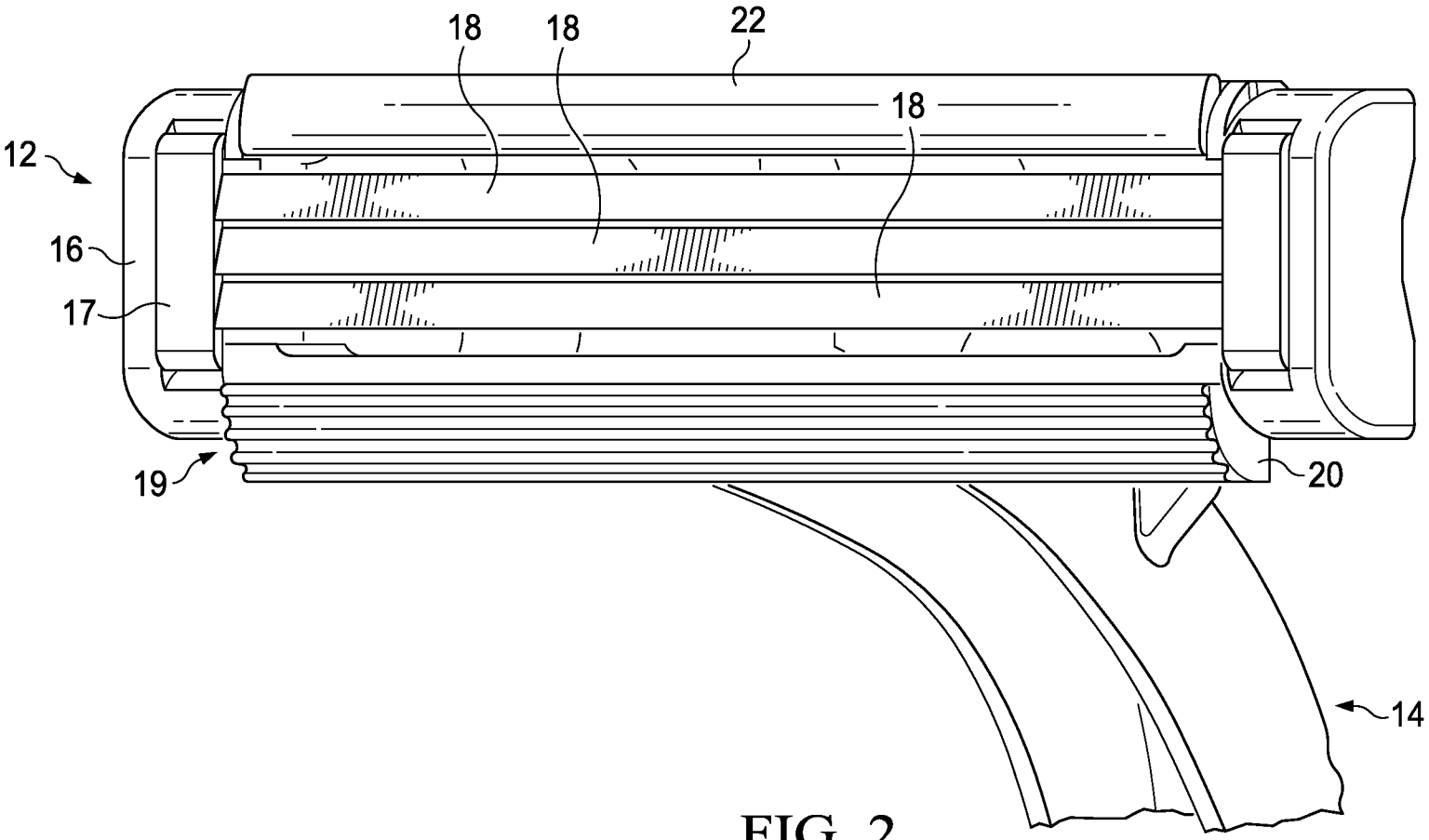
FIG. 2 is a front view of a razor cartridge of the FIG. 1 razor.

Referring to FIGS. 1 and 2, shaving razor 10 includes a cartridge 12 and a handle 14. The cartridge 12 may or may not be removable from the handle 13. The cartridge 12 may be connected to the handle directly or indirectly via a shell bearing structure (not shown) or any other feasible mechanism and the cartridge 12 may or may not pivot relative to the handle about a pivot axis.

As shown in FIG. 2, a close up of the cartridge 12 of FIG. 1 is shown. Cartridge 12 includes a housing 16, which carries three blades 18, a guard structure 20 in guard area 19 and cap 22. Clips 17 disposed on ends of the blades 18 assist in retaining the blades 18 in the housing 16.

Figure 3:
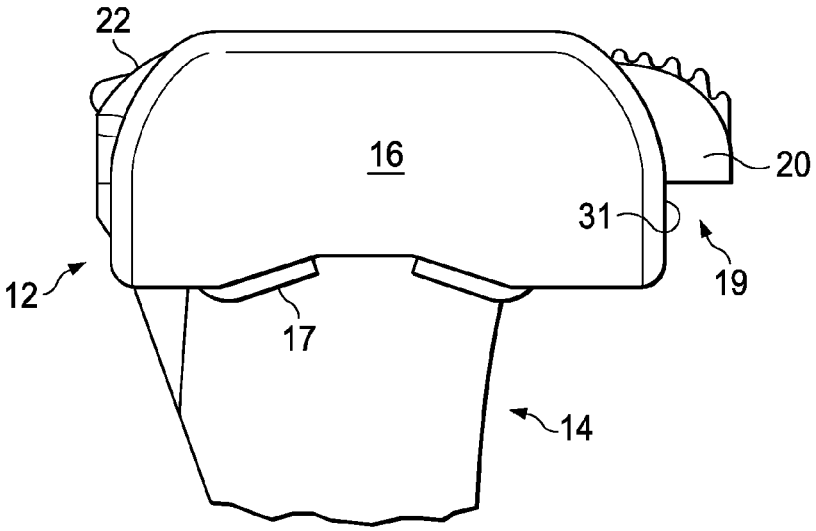
FIG. 3 is a side view of a razor cartridge of the FIG. 1 razor showing the overhang of the guard structure in accordance with the present invention.

These elements are also depicted in the FIG. 3 side view of razor cartridge 12. Additionally in FIG. 3, the guard structure 20 comprises protrusions which will be described in more detail below.

Figure 4:
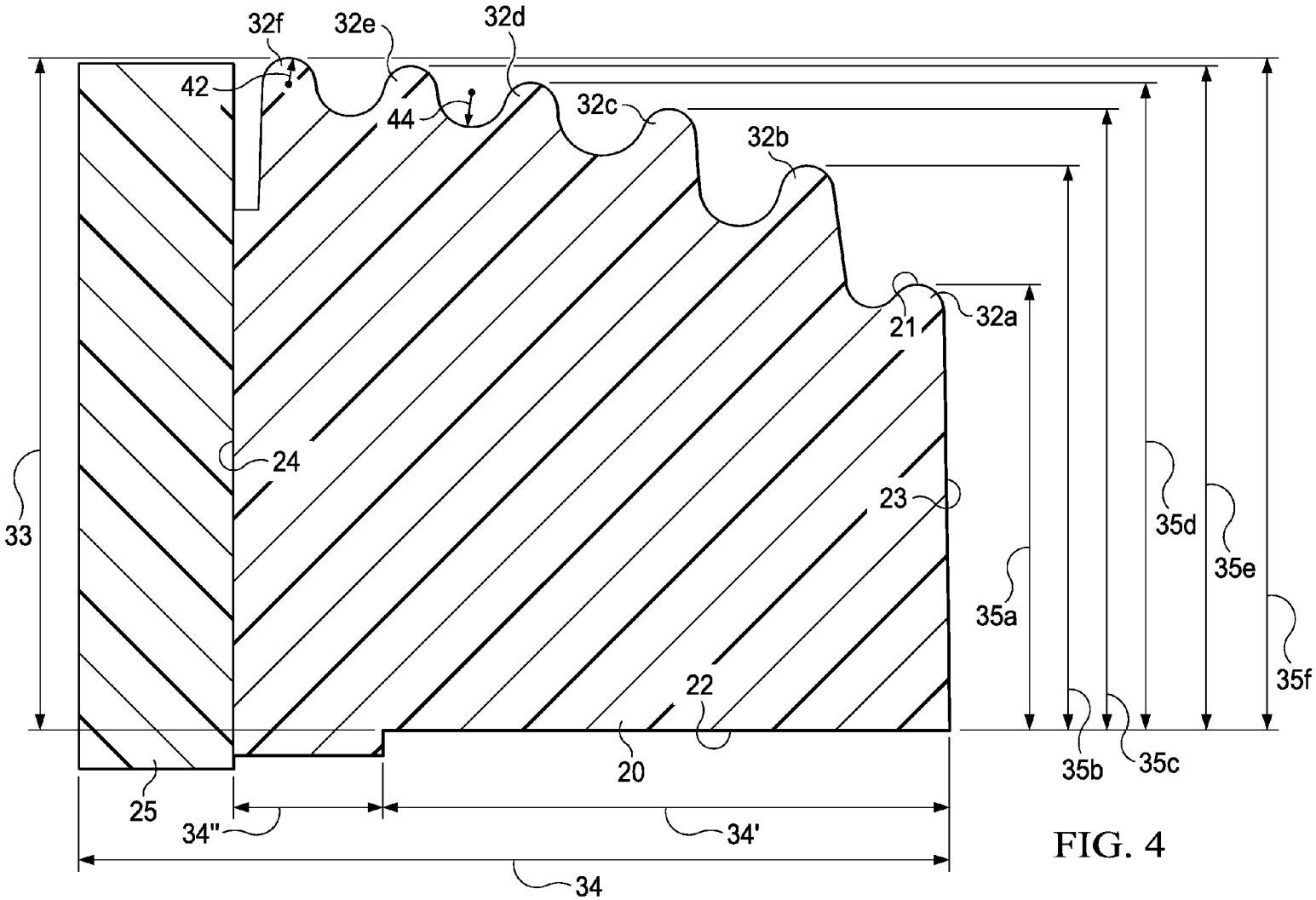
FIG. 4 is a cross-sectional side view of the guard structure of the razor cartridge of FIGS. 2 and 3 in accordance with the present invention.

In the present invention and as can be seen in FIGS. 1-3, and most clearly in FIG. 3, the guard structure 20 extends out beyond the front perimeter of the housing 16, effectively overhanging the front end 31 of the housing 16 by a depth or width 34' of preferably about 1.00 mm to about 3.00 mm, and most preferably, about 1.19 mm as depicted in FIG. 4. The portion 34" of the guard structure 20 that is necessarily supported by the housing may preferably be about 1.00 mm to about 2.00 mm, more preferably about 0.5 mm and therefore the total depth 34 of the guard structure 20 which may take into account the depth of the guard bar 25 (guard bar 25 is desirably disposed at the back end of the guard structure 20 and just in front of the blades, the latter not shown) may preferably range from about 1.00 mm to about 4.00 mm, more preferably about 2.52 mm.

One benefit of having an overhanging or substantially unsupported guard structure in the present invention is to provide an early or increase in skin contact with a user's skin prior to reaching the blades or cutting a user's hair by the blades. Another unforeseen benefit is that with the overhanging portion, the guard structure, though comprised of hard plastic, is provided with some degree of flexibility as it contacts a user's skin. This flexibility may be improved if the guard comprises less material under the protrusions or potentially a reduction in height 33.

A cross-sectional view of a guard structure 20 is shown in FIG. 4 to include a group of six protrusions, 32*a*, 32*b*, 32*c*, 32*d*, 32*e*, and 32*f* disposed at an upper surface 21 of the guard 20. Though six protrusions are shown, the present invention contemplates any feasible number of protrusions, preferably at least three protrusions, more preferably four protrusions and most preferably six protrusions. The protrusions are elongated and arranged generally parallel to the cutting edges of the blades.

The protrusions 32*a*-32*f* and/or preferably the entire guard structure 20 on which they are disposed are preferably comprised of a hard material such as polystyrene or high impact polystyrene (e.g., hard non-flexible plastic). The material may have a Shore A hardness of 80 to 55, preferably 75 to 65, and most preferably about 70. As values are increased above this range, performance may tend to deteriorate, and as values are decreased below this range, there may be production problems.

From the front end 23 of the guard structure towards the back end 24 of the guard structure 20 towards the blades 18 (not shown), the tips increase in elevation, disposed at increasing heights up from the bottom 22 to the top or upper surface 21 of the guard structure 20. The upper surface may generally be a top portion of a center of the rounded tip.

While the protrusions are desirably upstanding in the present invention for ease of manufacturability using injection molding processes, they may also be angled relative to each other or to the blades.

First tip 32*a*' is at a height 35*a* from the bottom 22 of about 1.61 mm, second tip 32*b*' is at a height 35*b* of about 2.05 mm from the bottom 22, third tip 32*c*' is at a height 35*c* of about 2.25 mm from bottom 22, fourth tip 32*d*' is at a height 35*d* of about 2.35 mm from the bottom 22, fifth tip 32*e*' is at a height 35*e* of about 2.41 mm in from the bottom 22, and sixth tip 32*f*' is at a height 35*f* of about 2.44 mm from the bottom 22 of the guard structure.

A maximum height 33 of the upper surface of the guard is substantially reached near or at the sixth tip 32*f*', that height being about 2.50 mm.

It should be noted that a tip represents the maximum or highest point on the protrusion. Preferably and as depicted, none of the tips are at the same height. It should be noted that the distance between the height of the first tip 32*a*' and the height of the second tip 32*b*' may be the largest difference as compared to the distances between heights of the remaining tips. In the present invention, the distance between the height 35*a* of the first tip 32*a*' and the height 35*b* of the second tip 32*b*' may be about double the distance between heights of the next adjacent tip and/or the remaining tips. For instance, first tip 32*a*' may desirably be about 0.4 mm lower than second tip 32*b*' while second and third tip heights 35*c* and 35*d* may differ by about 0.2 mm.

Additionally in accordance with the present invention, second tip 32*b*' may preferably be about 0.2 mm lower than third tip 32*c*' while third tip 32*c*' may preferably be about 0.1 mm lower than fourth tip 32*d*', fourth tip 32*d*' may be about 0.1 mm lower than fifth tip 32*e*', and fifth tip 32*e*' may be about 0.1 mm lower than sixth tip 32*e*'. Thus, the second tip 32*b*' of protrusion may be disposed such that it differs the most in height relative to neighboring tips, 32*a*' and 32*c*'.

While specific and generally preferred values are given above for various heights and height differentials of the protrusions, these values can vary by about +/−0.5 mm as contemplated by the present invention.

The preferred height arrangement may generally allow for a user's skin to be smoothly stretched and flattened and presented to the cutting blades uniformly. The configuration provides a low cost manufacturing solution by having one material for the housing and the guard while also providing protective functionality.

The protrusions of the present invention may be spaced apart from each other preferably by about 0.4 mm to about 0.6 mm, center to center.

The distance from the front of the first protrusion 32*a* to the back of the last protrusion 32*f* is about 2.53 mm. Alternatively, this distance can be from 2.0 mm to 3.5 mm.

While fins of the prior art are generally acute, the tips of the present invention are desirably rounded or curved and thus are not pointy tips, acute or sharp. As they are rounded, the tips' radius of curvature 42 of the present invention tips 32*a*', 32*b*', 32*c*', 32*d*', 32*e*', and 32*f*' may each preferably range from about 0.05 mm to about 0.20 mm. Though not shown, the radius of curvature for the tips 32*a*', 32*b*', 32*c*', 32*d*', and 32*e*', is disposed at a respective location for each tip as is shown for radius of curvature 42 at tip 32*f*'.

In use, the protrusions of the present invention tend to stimulate, flatten, stretch, and/or engage the skin in front of the blades, tending to improve comfort and proper positioning of the skin for cutting of hairs.

Figure 5:
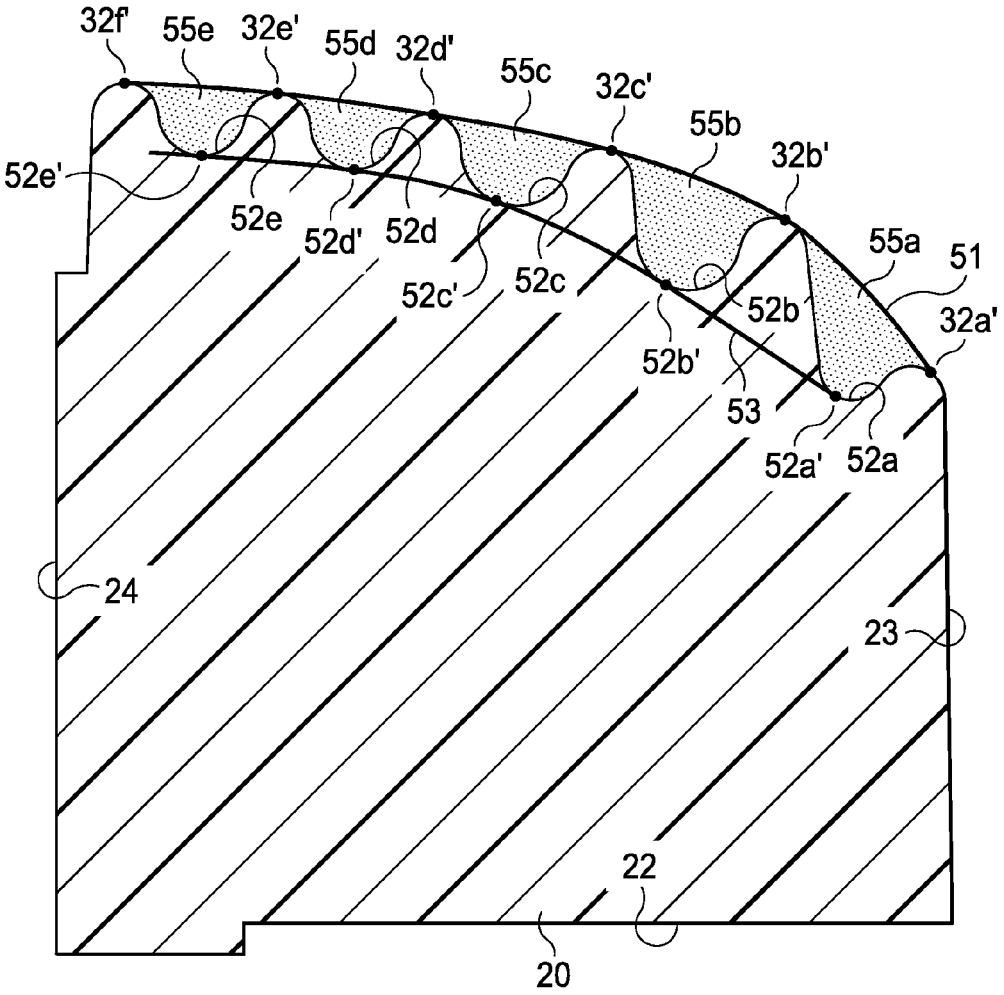
FIG. 5 is a cross-sectional side view of the guard structure of the razor cartridge showing the curvature profile in accordance with the present invention.

In addition, the present invention guard structure includes valleys or the space (inner protrusion volumes) between the protrusions and between the tips (as shown in more detail in FIG. 5). The valleys provide contact with the skin and increase friction which allows the dissipation or distribution of shaving aid or preparation to spread across a user's skin evenly. The arrangement of the valleys provides for easy rinsability and removal of debris.

The hard plastic protrusions with rounded tips on a curved profile provide a robust structure as the first skin contacting member just before engagement by the first blade, to improve skin stretching and improve comfort.

Since there is no substantial flexibility or resiliency in the protrusions, the user does not need to press harder to adjust the geometry of the exposure of the first blade and thereby by easing off the pressing, comfort is also improved.

Referring to FIG. 5, tips of the protrusions of FIG. 4 are connected via a curved line 51. In addition, each valley 52*a*, 52*b*, 52*c*, 52*d*, 52*e*, and 52*f*, is interspersed between the tips of FIG. 4, also shown connected via a curved line 53. It should be noted that valley points 52*a*', 52*b*', 52*c*', 52*d*', 52*e*', and 52*f*' represent the minimum or lowest point of each the valleys respectively, which are disposed between the protrusions.

As they are rounded, each valley has a radius of curvature 44 as shown in FIG. 4 for valley 52*d*. The valleys' radius of curvature 44 may each preferably range from about 0.05 mm to about 0.20 mm. Though not shown for every valley in FIG. 4, the valley radius of curvature is disposed at the same respective location for each remaining valley as is shown for radius of curvature 44 for tip 52*d* at point 52*d*'.

The curve profile 51 the tips and the curve profile 53 of the valley points in between the protrusion tips may or may not be the same.

Though any curved profile may generally be feasible, the curved profile of the guard structure, which may include the tips on a curve 51 may be preferably represented by the following equation (1):

$$y=0.0348\times x^5-0.3058x^4+1.0288x^3-1.7226x^2+1.6388x, \quad (1)$$

where x represents a distance from a front end 23 of the guard structure towards the blades and y represents a height of said protrusions relative to a first protrusion at the front end 23 of the guard structure.

Figure 6:
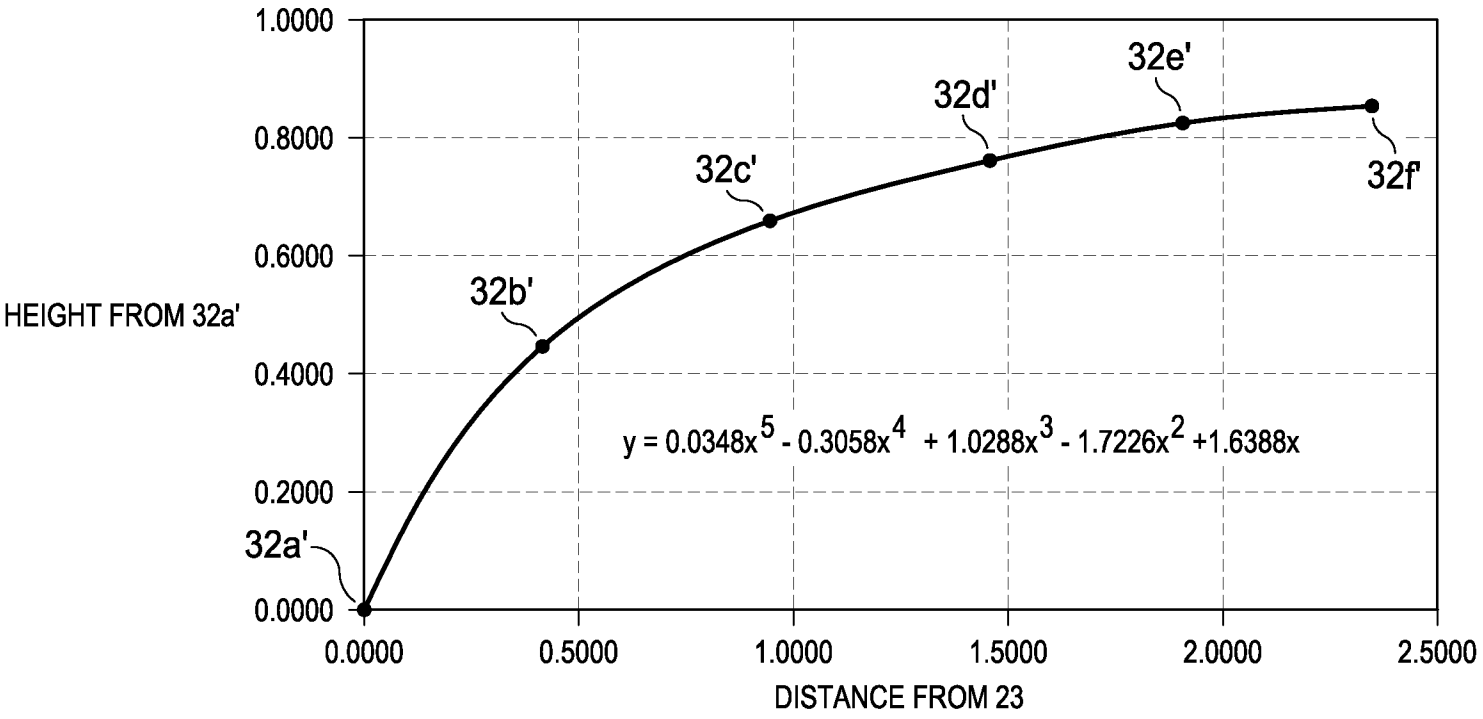
FIG. 6 is a graph representing the curvature profile of FIG. 5 in accordance with the present invention.

A graph of the guard structure curved profile 51 of the tips of protrusions of FIG. 4 or 5 as generally represented by the equation (1) above is depicted in FIG. 6.

It should be noted that in the graph of FIG. 6, the points of tangency of the profile curve (e.g., 32*f*', 23*d*', and so on) may or may not be the actual highest point on each protrusion shown in FIG. 5 though represented, for simplicity, in this manner.

The curve 53 of FIG. 5 of the valleys' lowest points 52*a*', 52*b*', 52*c*', 52*d*', 52*e*', and 52*f*', which are interspersed between the tips (or preferably the highest point of the protrusions) 32*a*', 32*b*', 32*c*', 32*d*', 32*e*', and 32*f*' may also be represented by a similar such curved profile graph as in FIG. 5, (e.g., an offset curve from the tips profile curve 51) or preferably by a different non-linear, curved profile than that of the tips' curved profile (not shown). Having a different curve helps to make the inner protrusion volume or cross-sectional area of the valleys (shown in FIG. 5) different which in turn provides the ability to improve shave prep retention and distribution on the skin, as will be discussed in more detail below.

It is noted that the highest point on each protrusion may vary, generally on the order of +/− 0.1 mm in all directions. Due to this variation, the resulting curve of the present invention may change, thereby resulting in a modified equation from equation (1). Variability may occur for many reasons, including but not limited to, variability in manufacturing process outcomes (such as with injection molding), which is a preferred method to make the guard structure of the present invention.

Turning to FIG. 5, inner protrusion volumes 55*a*, 55*b*, 55*c*, 55*d*, and 55*e* depict the inner volume amount generally capable of being encompassed under curve 51 and between tips of adjacent protrusions. It is noted that the present invention contemplates that the inner protrusion volumes may generally be different than each other, generally increase from lowest to highest going from the back end of the guard structure to the front end of the guard structure, that some inner protrusion volumes are substantially the same, that the volume 55*b* may be greater than the volume 55*c* and both are greater volumes than remaining volumes.

For instance, it may generally be desirable that the front end inner protrusion volumes (e.g., 55*a*, 55*b*) be greater than those inner protrusion volumes towards the back end (e.g., 55*c*, 55*d*, and 55*e*). While any feasible range of volume values is contemplated by the present invention, as shown in FIG. 5, the values may preferably be about 0.082 $mm^2$ for inner protrusion volume 55*a*, about 0.098 $mm^2$ for inner protrusion volume 55*b*, about 0.059 $mm^2$ for inner protrusion volume 55*c*, and about 0.044 $mm^2$ for inner protrusion volumes 55*d* and 55*e*. Expressed in terms of percentage of the leading valley's inner protrusion volume (e.g., 55*a*), with 55*a* being at 100%, the remaining inner protrusion volumes may be as follows: inner protrusion volume 55*b* is about 120% percent of that of inner protrusion volume 55*a*, inner protrusion volume 55*c* is about 72% percent of that of inner protrusion volume 55*a*, and inner protrusion volumes 55*d* and 55*e* are both about 54% percent of that of inner protrusion volume 55*a*.

The benefit of having a generally increasing arrangement of volumes is the ability to capture shaving aid material (or shave prep) in larger amounts in the valleys interspersed between the protrusions and particularly in the front end guard structure areas allowing for more shaving aid material and better distribution of shaving aid material across a user's skin particularly since the front end guard structure is the initial skin contact area. The ability to provide more shaving aid distribution over a user's skin is beneficial for alleviating discomfort and for continuing to lubricate hair. Theoretically, such a volume arrangement may leave behind or allow some shaving aid material to be reapplied in subsequent strokes after a user has initially applied it on their skin, rather than being completely wiped off by the guard which may also be a desirable attribute for similar reasons.

Desirably, substantially most, if not all, of the protrusions of the present invention have rounded tips. The present invention contemplates alternate embodiments where some of the protrusions have tips which are not rounded but rather sharp or acute, and as such the guard structure has protrusions with a mixture of rounded and acute tips.

Figure 7:
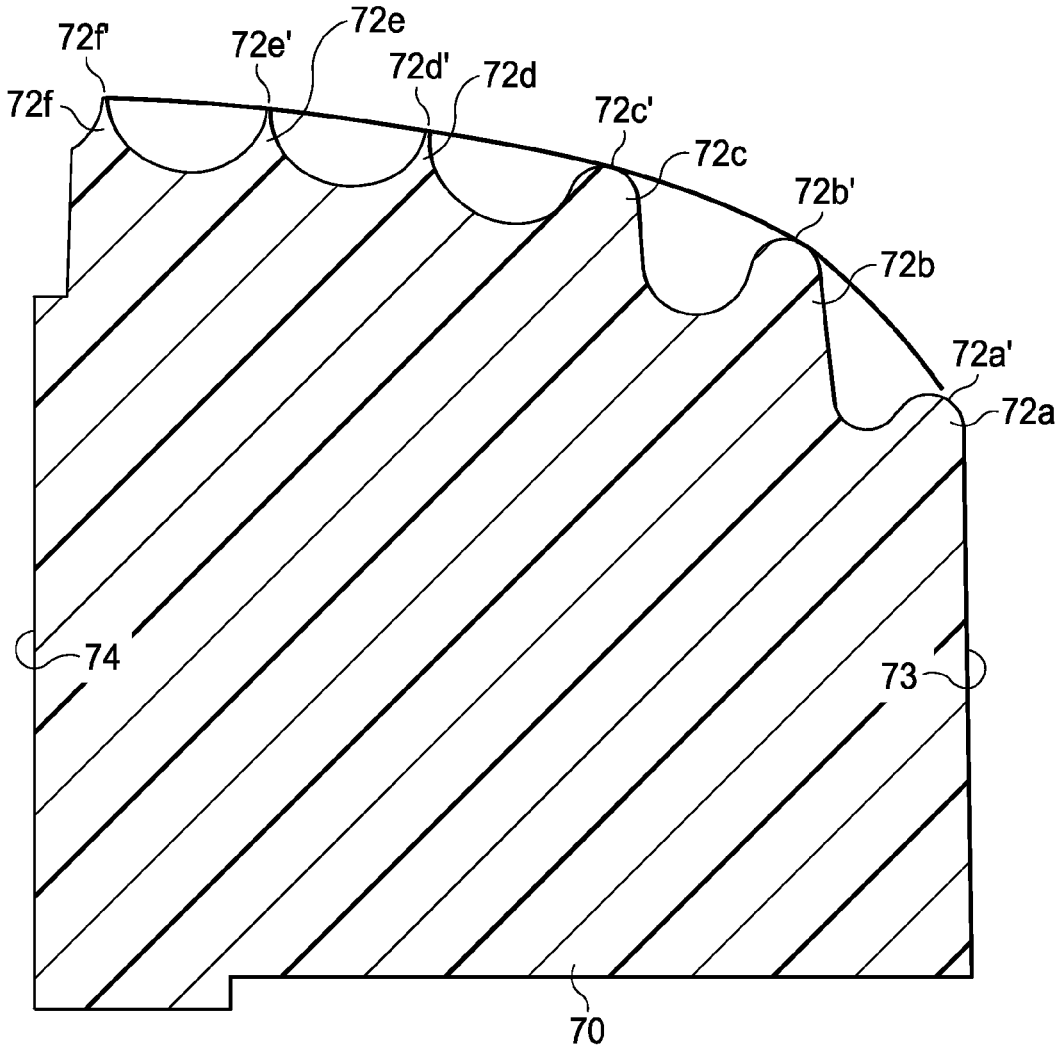
FIG. 7 is an alternate embodiment of the present invention.

FIG. 7 depicts such an alternate; embodiment of a guard structure where the arrangement shows sharp tips 72*d*', 72*e*', and 72*f*' of protrusions 72*d*, 72*e*, and 72*f*, respectively, generally desirably disposed towards the back end 74 of the guard structure 70 and the rounded tips 72*a*', 72*b*', and 72*c*' of protrusions 72*a*, 72*b*, and 72*c*, respectively towards the front end 73 of the guard structure. In this way, if the protrusions are all made of a hard plastic, the rounded tips, and not the sharp pointy hard tips, are the first to contact to a user's skin thereby providing more initial comfort. Additionally, the tips of FIG. 7 may still be arranged as shown along the same or similar curve profile of FIG. 6.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor comprising:

a cartridge comprising a housing, said housing including a guard structure in front of a plurality of blades, said guard structure comprising a plurality of rows of elongated hard plastic protrusions having rounded tips arranged on a tip curved profile, and more than half of said guard structure is unsupported and extends beyond said housing in an overhanging manner, and wherein said protrusions comprise valleys between said protrusions, said valleys are arranged on a valley curved profile different than said tip curved profile, and said valley curved profile provides said valleys with different cross sectional areas for improving shaving aid retention.

2. The razor of claim 1 wherein said valleys are rounded.

3. The razor of claim 1 wherein an inner protrusion volume of said valleys encompassed under said tip curved profile at a front end of said guard structure are larger volumes than the volumes at a back end of said guard structure.

4. The razor of claim 1 wherein inner protrusion volumes range from 0.044 $mm^3$ to 0.098 $mm^3$.

5. The razor of claim 1 wherein said curved profile of said guard structure is represented by the equation $$y=0.0348x^5-0.3058x^4+1.0288x^3-1.7226x^2+1.6388x$$

where x is a distance from a front end of the guard structure towards the blades and y is a height of said protrusions relative to a first protrusion at the front of the guard structure.

6. The razor of claim 1 wherein said plurality of blades are formed within a housing and said guard structure extends between 1 mm to 3 mm beyond a front end of said housing.

7. The razor of claim 1 wherein said protrusions range in height from 1.50 mm to 2.50 mm measured from a bottom of said guard structure to said rounded tips.

8. The razor of claim 1 wherein each of said rounded tips comprises a tip radius ranging from 0.05 mm to 0.20 mm.

9. The razor of claim 1 wherein a distance between said protrusions ranges from 0.4 mm to 0.6 mm.

10. The razor of claim 1 wherein there are at least four protrusions on an upper surface of said guard structure.

11. The razor of claim 1 wherein there are six protrusions on an upper surface of said guard structure.

12. The razor of claim 1 wherein a first protrusion tip from a front end of a guard structure is 0.4 mm lower than a second protrusion tip.

13. The razor of claim 1 wherein said hard plastic is comprised of high impact polystyrene, polyphenylene oxide, polystyrene, polypropelene, acrylonitrile butadiene styrene, or any combination thereof.

14. The razor of claim 1 further comprising a plurality of rows of elongated hard plastic protrusions having acute tips and arranged on said tip curved profile.

* * * * *